US008800520B2

(12) United States Patent
D'Amore

(10) Patent No.: US 8,800,520 B2
(45) Date of Patent: Aug. 12, 2014

(54) HYDRAULIC LASH ADJUSTER, A VALVE TRAIN COMPRISING THE SAME AND A METHOD OF ASSEMBLING THE SAME

(71) Applicant: Eaton Srl, Turin (IT)

(72) Inventor: Massimo D'Amore, Rivoli (IT)

(73) Assignee: Eaton SRL, Turin (IT)

( * ) Notice: Subject to any disclaimer, the term of this patent is extended or adjusted under 35 U.S.C. 154(b) by 0 days.

(21) Appl. No.: 13/889,389

(22) Filed: May 8, 2013

(65) Prior Publication Data

US 2013/0298859 A1 Nov. 14, 2013

(30) Foreign Application Priority Data

May 8, 2012 (GB) ..... 1207977.8

(51) Int. Cl.
*F01L 1/14* (2006.01)
*F01L 1/24* (2006.01)
*F01L 1/18* (2006.01)

(52) U.S. Cl.
CPC ..... *F01L 1/24* (2013.01); *F01L 2105/00* (2013.01); *F01L 1/2422* (2013.01); *F01L 2001/188* (2013.01)
USPC ..... 123/90.57; 123/90.52; 123/90.55

(58) Field of Classification Search
CPC ..... F01L 1/24; F01L 1/2422; F01L 2001/188
USPC ..... 123/90.52, 90.55, 90.57
See application file for complete search history.

(56) References Cited

U.S. PATENT DOCUMENTS 7,325,523 B2 * 2/2008 Sailer et al. ..... 123/90.52

FOREIGN PATENT DOCUMENTS

JP 3217604 A1 4/1995
WO WO 0020730 A1 4/2000

* cited by examiner

*Primary Examiner* — Ching Chang
(74) *Attorney, Agent, or Firm* — Leydig, Voit & Mayer, Ltd.

(57) ABSTRACT

A hydraulic lash adjuster includes a body and a plunger assembly slideably mounted with respect to the body. A first chamber is defined by the body and the plunger assembly and is configured to contain a hydraulic fluid. A second chamber is configured to supply the hydraulic fluid to the first chamber through a valve disposed between the first and second chambers in response to a movement of the plunger assembly that increases the volume of the first chamber. An aperture opens into the second chamber. A stopper is insertable into the aperture during use of the hydraulic lash adjuster such that the stopper restrains the hydraulic fluid from exiting the second chamber through the aperture and enables air to exit the second chamber through the aperture.

13 Claims, 3 Drawing Sheets

HYDRAULIC LASH ADJUSTER, A VALVE TRAIN COMPRISING THE SAME AND A METHOD OF ASSEMBLING THE SAME

CROSS-REFERENCE TO PRIOR APPLICATIONS

Priority is claimed to British Patent Application No. GB 1207977.8, filed on May 8, 2012, the entire disclosure of which is hereby incorporated by reference herein.

FIELD

The present invention relates to a hydraulic lash adjuster, a valve train comprising a hydraulic lash adjuster and a method of assembling a hydraulic lash adjuster.

BACKGROUND

Hydraulic Lash Adjusters (HLA) for taking up slack in valve trains are well known. One common type of valve train comprises a rocker arm mounted for pivotal movement about a central rocker shaft. One end of the rocker arm comprises a roller mounted on an axle carried by the rocker arm. The roller is for engaging a cam mounted on a cam shaft. The other end of the rocker arm carries a hydraulic lash adjustor having a ball end which engages a socket of a stem of a valve for an engine cylinder. The cam has a base circle and a lift profile (i.e. a lobe) and as the cam shaft rotates, when the lobe engages the roller the rocker arm pivots about the central shaft and the HLA exerts a force on the valve stem depressing the valve stem against the force of a valve spring and thus opening the valve. As the peak of the lift profile passes out of engagement with the roller, the return spring begins to close the valve. When the base circle again comes into engagement with the roller, the valve is closed.

As is well known, a typical HLA comprises an oil-containing chamber defined between an outer body and a plunger assembly slideably mounted within the outer body, and a spring arranged to enlarge the chamber by pushing the plunger assembly outwardly from the outer body to extend the HLA. Oil flows into the chamber via a one way valve, but can escape the chamber only slowly, for example, via closely spaced leak down surfaces. Accordingly, a HLA can extend to accommodate any slack in the valve train assembly, such as between the cam and the roller but, after it is extended, the incompressible oil in the chamber provides sufficient rigid support for the HLA to open the valve when the rocker arm pivots (i.e. it prevents the plunger assembly being pushed back inwardly of the outer body so that the HLA acts as a solid body). Typically, the HLA has a second chamber, defined by the plunger assembly, on the other side of the one way valve from the first chamber and which is in fluid communication with the engine's oil supply. Oil supplied from the engine's oil supply is retained within the second chamber and flows into the first chamber through the one way valve when the HLA extends.

It is important that air trapped in the second chamber above the level of oil in that chamber can be purged from the second chamber when the oil level rises. To that end, some hydraulic lash adjusters are provided with a very small diameter aperture that opens into the second chamber and that allows air to purge from the chamber when the oil level rises. The diameters of these holes are large enough to allow sufficient air to purge from the system but not so large as to allow un-desirable oil leakage.

JP 3217604 describes a system in which a float is provided on the surface of the oil in a HLA chamber and which rises as the oil rises in the chamber and which blocks an air purge aperture when the oil completely fills the chamber to prevent oil leaking from the chamber.

SUMMARY

In an embodiment the present invention provides a hydraulic lash adjuster including a body and a plunger assembly slideably mounted with respect to the body. A first chamber is defined by the body and the plunger assembly and is configured to contain a hydraulic fluid. A second chamber is configured to supply the hydraulic fluid to the first chamber through a valve disposed between the first and second chambers in response to a movement of the plunger assembly that increases the volume of the first chamber. An aperture opens into the second chamber. A stopper is insertable into the aperture during use of the hydraulic lash adjuster such that the stopper restrains the hydraulic fluid from exiting the second chamber through the aperture and enables air to exit the second chamber through the aperture.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

In an embodiment, the present invention provides an alternative arrangement by means of which air can be purged from a hydraulic lash adjuster.

In accordance with an embodiment of the invention there is provided an hydraulic lash adjuster comprising: a body; a plunger assembly slideably mounted with respect to the body; wherein the body and the plunger assembly define a first chamber for containing a hydraulic fluid and the lash adjuster defines a second chamber for supplying hydraulic fluid to the first chamber through a valve located between the first and second chambers in response to movement of the plunger assembly increasing the volume of the first chamber; and wherein the hydraulic lash adjuster defines an aperture opening into the second chamber, characterized by the lash adjuster further comprising a stopper for inserting into the aperture, wherein in use, when the stopper is inserted in the aperture, the stopper is arranged to restrain hydraulic fluid from exiting the second chamber through the aperture and to enable air to exit the second chamber through the aperture.

In accordance with another embodiment of the invention, there is provided a method of assembling such an hydraulic lash adjuster, the method comprising: inserting an implement through the aperture into the second chamber; and using the implement to open the valve between the first chamber and the second chamber when a lash adjuster pump up procedure is being performed.

In accordance with a further embodiment of the invention, there is provided a valve train assembly comprising such a hydraulic lash adjuster.

Figure 1:
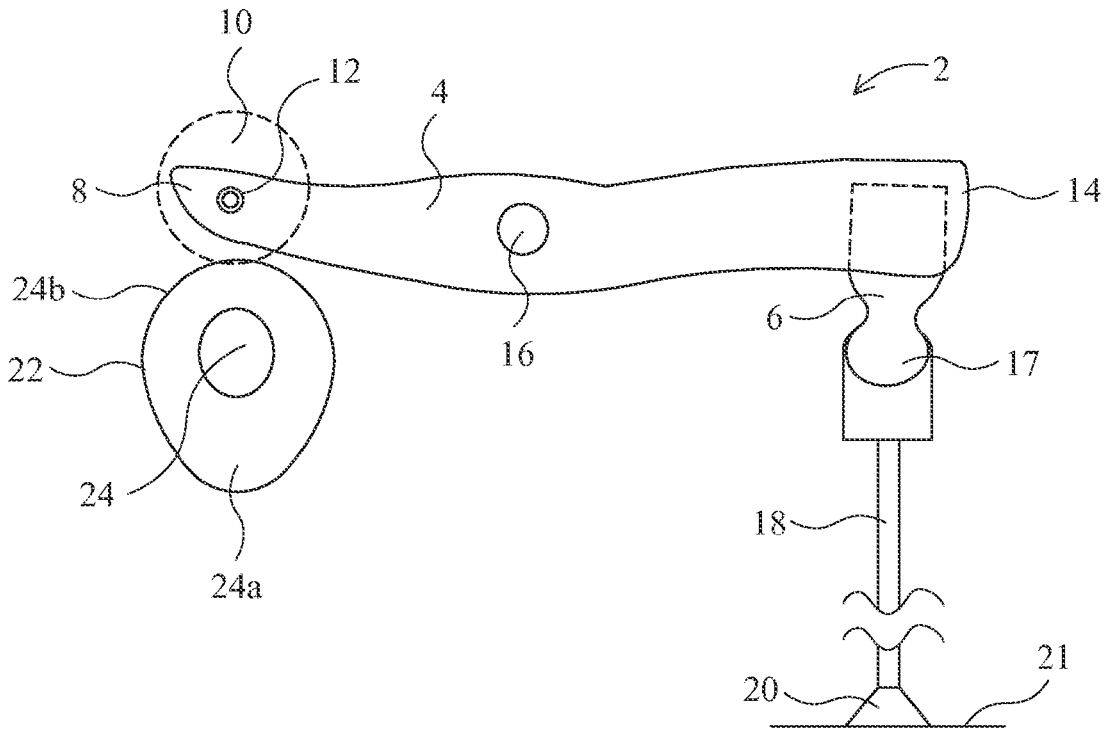
FIG. 1 illustrates a schematic side view of a valve train assembly including an hydraulic lash adjuster.

Referring first to FIG. 1, a valve train assembly 2 comprises a rocker arm 4 and a hydraulic lash adjuster 6. One end 8 of the rocker arm 4 is provided with a roller 10 rotatably mounted on an axle 12 and the other end 14 of the rocker arm 4 supports the hydraulic lash adjuster 6. The rocker arm 4 is pivotally mounted, at around its midpoint, on a rocker arm axle 16. The hydraulic lash adjuster 6 comprises a part spherical end 17 for engaging a complimentary shaped socket of a valve stem 18 of a valve 20 of an engine cylinder 21.

A cam 22 mounted on a cam shaft 24 has a lobe 24*a* which as the cam 22 rotates with the cam shaft 24 engages the roller 10 and thus causes the rocker arm 4 to pivot clockwise, as shown in the drawing, about the axle 16 whereby the hydraulic lash adjuster 6 depresses the valve stem 18 against the force of a valve spring to open the valve 20. As the cam 22 continues to rotate, once the peak of the lobe 24*a* has passed out of engagement with the roller 10 the valve 20 begins to close under the action of the valve spring. Once a base circle 24*b* of the cam 22 is engaged with the roller 10 the valve 20 is fully shut.

Figure 2:
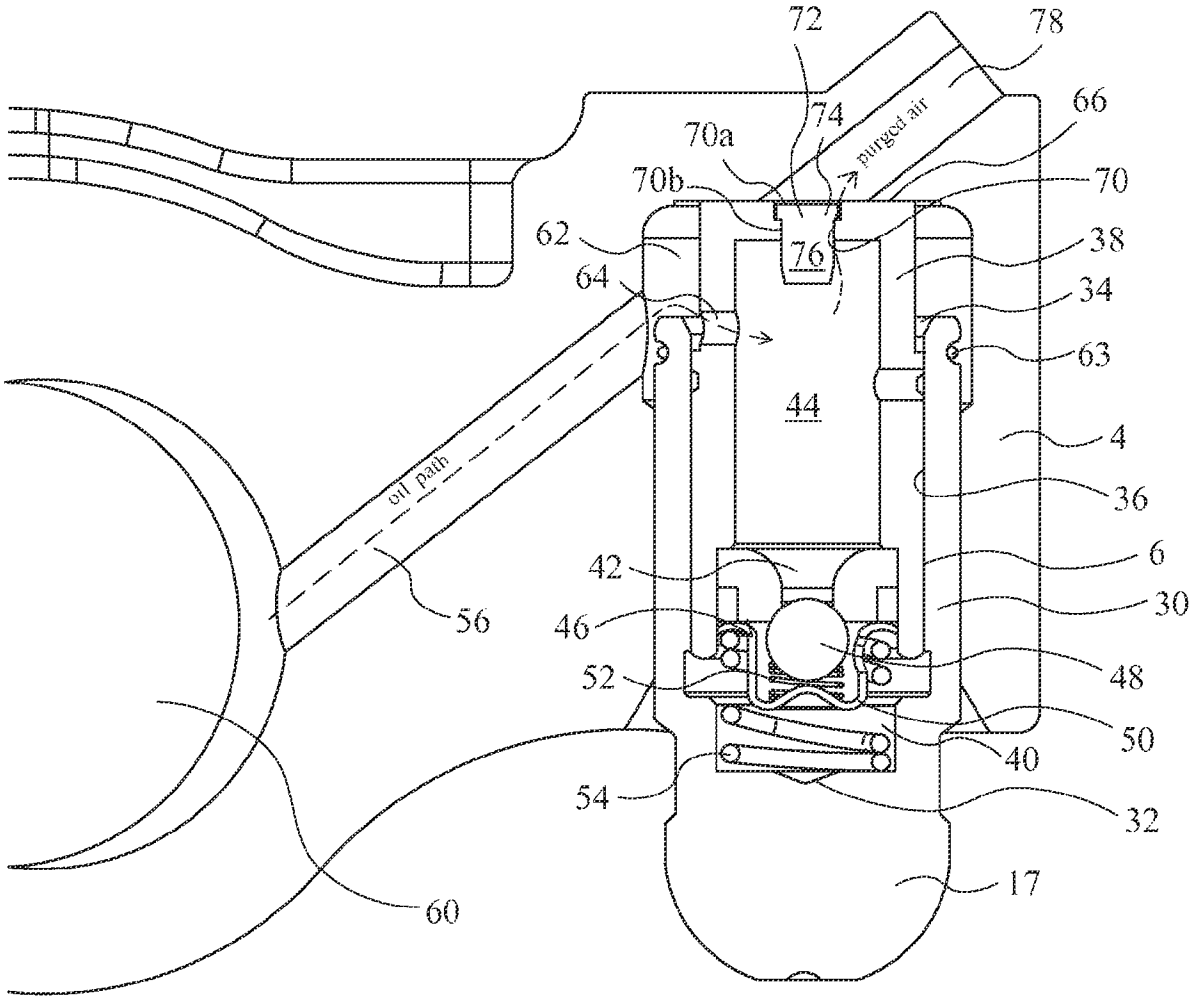
FIG. 2 illustrates a schematic longitudinal cross sectional view of part of the rocker arm and the hydraulic lash adjuster.

Referring now to FIG. 2, the lash adjuster 6 comprises an outer body 30 having a closed end 32 and an open end 34 and which defines a longitudinal bore 36 between the closed 32 and open 34 ends. The closed end 32 is formed partly spherical and is for engaging the valve stem 18. A plunger assembly 38 is mounted for sliding movement back and forth within the bore 36, its upper end extending above the bore 36.

The plunger assembly 38 and the outer body 30 define between them a first oil chamber 40 towards the bottom of the bore 36 (i.e. towards the bottom of the HLA 6). An aperture 42 at the bottom of the plunger assembly 38, which as is conventional and will be explained below, allows oil to flow from a second oil chamber, or oil reservoir, 44 within the plunger assembly 38 into the first oil chamber 40 when the HLA 6 extends. Below the aperture 42, a ball valve 46 is provided which comprises a ball 48 captured by a cage 50 and biased by a spring 52 to a position closing the aperture 42. The plunger assembly 38 is biased outwardly of the outer body 30 by means of a spring 54 held within the first oil pressure chamber 40.

In use, the spring 54 expands the overall length of the lash adjuster 6 by pushing the plunger assembly 38 outwardly of the outer body 30 so as to take up any slack in the valve train assembly 2. As the plunger assembly 38 moves outwardly, the volume of the first chamber 40 increases and a resulting oil pressure differential across the ball 48 moves it against the bias of the spring 52, opening the aperture 42 and enabling oil to flow from the second oil chamber 44 into the first oil chamber 40. When the plunger assembly 38 stops moving outwardly, and the oil pressure across the ball 48 equalises, the ball 48 closes the aperture 42 under the action of the spring 52. When pressure is applied to the upper end of the HLA 6 by the rocker arm 4 as the rocker arm 4 pivots, inward movement of the plunger assembly 38 is inhibited by the high pressure of oil in the first oil chamber 40. The oil in the first oil chamber 40 cannot flow back into the second oil chamber 44 because of the ball 48. As is standard, oil can escape the first oil chamber 40 (which enables the HLA to collapse again) by leaking between the surface of the bore 36 and the outer surface of the plunger assembly 38, but this can occur only very slowly (particularly if the oil is cold) because the bore 36 and the plunger assembly 38 are made to tight tolerances to restrict oil flow.

The oil in the second oil chamber 44 is kept supplied from the engine's oil supply via an oil supply path at least in part defined by a first conduit formed in the rocker shaft 16 and a second conduit 56 drilled through the rocker arm 4 from an aperture 60, through which the rocker shaft 16 extends, to a cavity 62 in which the HLA 6 is supported by a clip 63. Oil supplied via the oil supply path into the cavity 62 can flow into the first oil chamber 44 through a hole 64 formed through a side wall 65 of the plunger assembly 38. The arrangement described so far is conventional and its operation will be clear to those skilled in the art.

An upper wall 66 of the plunger assembly 38 defines a bore or aperture 70 that extends all of the way through the upper wall 66 into the second chamber 44. In embodiments of the present invention, advantageously, the HLA 6 is provided with a stopper 72 for inserting into the aperture 70, wherein in use, when the stopper 72 is inserted in the aperture 70, the stopper 72 is arranged to restrain hydraulic fluid (e.g. oil) from exiting the second chamber 44 through the aperture 70 and to enable air to exit the second chamber 44 through the aperture 70. In other words, the stopper 72 allows air to be purged from the second chamber 44 but prevents excessive oil leakage there from.

In this example, the bore 70 comprises a first cylindrical portion 70*a*, having an open end at the outer surface of the upper wall 66, and a second cylindrical portion 70*b*, of smaller diameter but longer than the first cylindrical portion 70*a*, having an open end at the inner surface of the upper wall 66.

Figure 3:
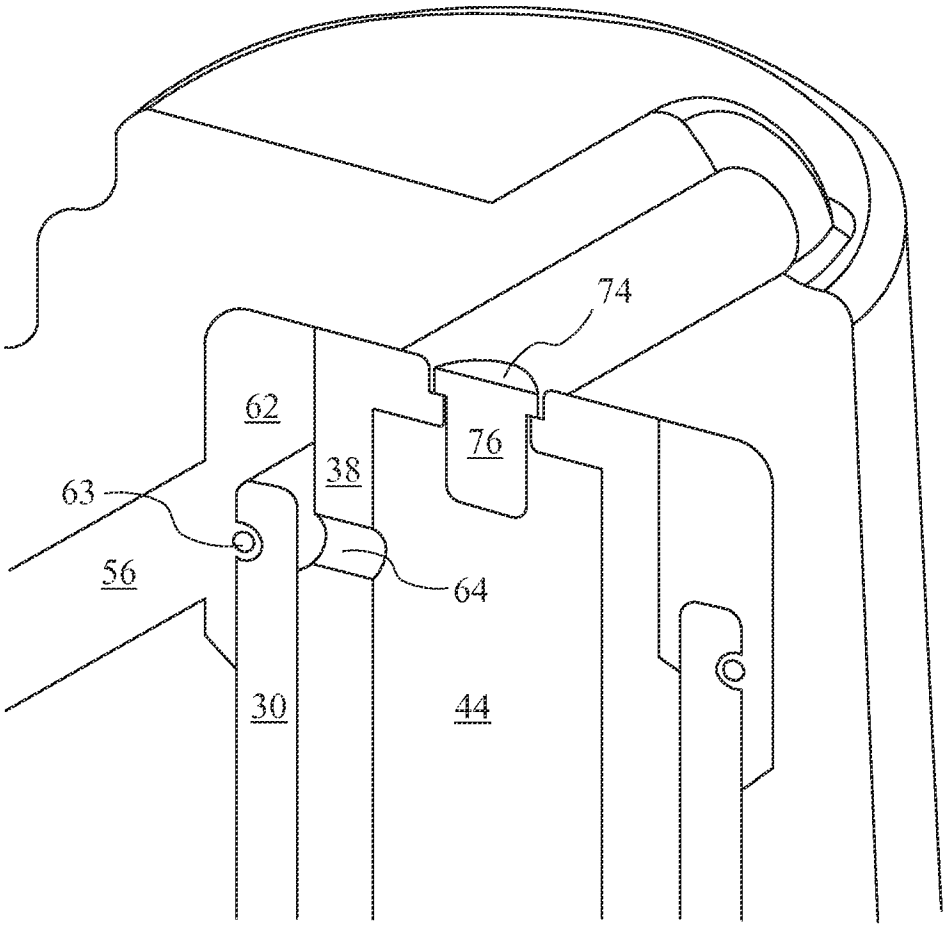
FIG. 3 illustrates a schematic cutaway and perspective view of the hydraulic lash adjuster in part of the rocker arm.

In this example, as seen in FIG. 3, the stopper 72 comprises a cap portion 74 that rests in the first portion 70*a* of the bore 70 and a stem portion 76 that extends through the second portion 70*b* of the bore 70 into the second pressure chamber 44.

Advantageously, in this example, the minimum diameter of the bore 70 (e.g. the diameter of the second portion 70*b*) is such that prior to the lash adjuster 6 being installed on the rocker arm 4 and prior to the stopper 72 being installed in the bore 70, it is possible to insert a needle, or any other suitable implement, through the bore 70 into the second chamber 44 in order to open the ball valve 46 during the so called 'pump-up' operation (i.e. an extending of the lash adjuster) typically performed during manufacture of the hydraulic lash adjuster 6. After completion of the 'pump-up' operation, the stopper 72 is inserted into the bore 70 and the lash adjuster 6 is installed in the rocker arm 4.

The stopper 72 is dimensioned so that the seal it forms with the plunger assembly 38 in the bore 70 is good enough to prevent excessive oil leakage from the second oil chamber 44 but is not air tight, so that air above the level of oil in the second oil chamber 44 is purged out of the second oil chamber 44 if the oil level rises. In this example, as can be seen in FIG. 2, the diameter of the cap portion 74 is slightly smaller than that of the first portion 70*a* of the bore 70 and the diameter of the stem portion 76 is slightly smaller than that of the second portion 70*b* of the bore 70, so that a small 'diametric' gap exists between the stopper 72 and the plunger assembly 30 through which air can be purged from the second oil chamber 44 into a third conduit 78 drilled through the rocker arm 4 into the cavity 62. The shape of the stopper 72 in the described embodiment allows for easy installation into the bore 70 and its length is selected so that it is difficult for pressurized oil to force the plug out of the bore.

Preferably, the gap between the upper surface of the cap portion 74 and the surface of the third conduit 78 in the region above the stopper 74 when it is installed in the 70 is relatively small compared to the overall length of the stopper 72 so that the rocker arm 4 itself helps retain the stopper 72 in the bore 70 against the pressure of oil in the second oil chamber 44.

Accordingly, it can be understood that in this example the aperture 70 is large enough to facilitate the assembly process of the HLA, but, when the HLA is in use, the gap between the stopper 72 and the plunger assembly 38 is small enough to prevent excessive oil leakage whilst allowing necessary air purging. Preferably, the minimum diameter of the aperture 70 is in the range of 1.5 mm to 3 mm, and most preferably in the range 1.75 mm to 2.5 mm, which is large enough to allow a needle to be inserted into the chamber 44, but without being overly large.

The above embodiment is to be understood as an illustrative example of the invention only. Further embodiments of the invention are envisaged. For example, in an alternative embodiment, the lash adjuster 6, rather than being supported by a rocker arm as described above, is supported by a valve train cover, for example of the type described in commonly-owned application WO 00/20730, the part spherical end of the lash adjuster 6 acting as the pivot point for a rocker arm to which it is attached. The shapes of the stopper 72 and the aperture 70 may also vary widely from those of the described embodiment. In one alternative the stopper comprises two parts, a first outer part that sits permanently and tightly in the aperture 70 once installed, and a second inner part that is removably insertable in an aperture that extends all of the way through the first part. In this example, the air is purged through the aperture via a gap that results from the relatively loose fitting of the second part in the first part. The stopper may also comprises valve components arranged to allow air to pass through but prevent oil from passing through. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention.

What is claimed is:

1. A hydraulic lash adjuster, comprising:
- a body;
- a plunger assembly slideably mounted with respect to the body;
- a first chamber defined by the body and the plunger assembly and configured to contain a hydraulic fluid;
- a second chamber configured to supply the hydraulic fluid to the first chamber through a valve disposed between the first and second chambers in response to a movement of the plunger assembly that increases the volume of the first chamber;
- an aperture opening into the second chamber; and
- a stopper insertable into the aperture during use of the hydraulic lash adjuster such that the stopper restrains the hydraulic fluid from exiting the second chamber through the aperture and enables air to exit the second chamber through the aperture.

2. The hydraulic lash adjuster according to claim 1, wherein the aperture is defined by the plunger assembly.

3. The hydraulic lash adjuster according to claim 1, wherein the air exits the second chamber through the aperture via a gap defined by the stopper and the lash adjuster, or via a gap defined by the stopper.

4. The hydraulic lash adjuster according to claim 1, wherein the stopper comprises a cap portion and a stem portion, the cap portion having a greater diameter than the stem portion.

5. The hydraulic lash adjuster according to claim 4, wherein, during use with the stopper inserted into the aperture, the stem portion extends into the second chamber.

6. The hydraulic lash adjuster according to claim 1, wherein a minimum diameter of the aperture is in a range of 1.50 mm to 3.00 mm.

7. The hydraulic lash adjuster according to claim 6, wherein the minimum diameter of the aperture is in a range of 1.75 mm to 2.50 mm.

8. A method of assembling a hydraulic lash adjuster, the method comprising:
- providing the hydraulic lash adjuster comprising:
  - a body;
  - a plunger assembly slideably mounted with respect to the body;
  - a first chamber defined by the body and the plunger assembly and configured to contain a hydraulic fluid;
  - a second chamber configured to supply the hydraulic fluid to the first chamber through a valve disposed between the first and second chambers in response to a movement of the plunger assembly that increases the volume of the first chamber;
  - an aperture opening into the second chamber; and
  - a stopper insertable into the aperture during use of the hydraulic lash adjuster such that the stopper restrains the hydraulic fluid from exiting the second chamber through the aperture and enables air to exit the second chamber through the aperture;
- inserting an implement through the aperture into the second chamber;
- using the implement to open the valve between the first chamber and the second chamber during performance of a lash adjuster pump up procedure; and
- inserting the stopper into the aperture.

9. The method according to claim 8, further comprising:
- attaching the hydraulic lash adjuster to a valve train assembly.

10. A valve train assembly comprising:
- a valve train component holding a hydraulic lash adjuster comprising:
  - a body;
  - a plunger assembly slideably mounted with respect to the body;
  - a first chamber defined by the body and the plunger assembly and configured to contain a hydraulic fluid;
  - a second chamber configured to supply the hydraulic fluid to the first chamber through a valve disposed between the first and second chambers in response to a movement of the plunger assembly that increases the volume of the first chamber;
  - an aperture opening into the second chamber; and
  - a stopper insertable into the aperture during use of the hydraulic lash adjuster such that the stopper restrains the hydraulic fluid from exiting the second chamber through the aperture and enables air to exit the second chamber through the aperture.

11. The valve train assembly according to claim 10, wherein the valve train component is configured to inhibit the stopper from being pushed out of the aperture by the hydraulic fluid in the second chamber.

12. The valve train assembly according to claim 11, wherein the valve train component is a rocker arm or a rocker arm carrier.

13. The valve train assembly according to claim 11, wherein a surface of the valve train component faces the stopper such that, during use of the valve train assembly, contact with the surface restrains the stopper in the aperture upon the hydraulic fluid in the second chamber acting to push the stopper outwardly from the aperture.

* * * * *